US008695908B2

(12) United States Patent
Matsumura

(10) Patent No.: US 8,695,908 B2
(45) Date of Patent: Apr. 15, 2014

(54) SANITARY THIN PAPER ROLL

(75) Inventor: Takashi Matsumura, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 799 days.

(21) Appl. No.: 12/733,388

(22) PCT Filed: Aug. 26, 2008

(86) PCT No.: PCT/JP2008/065194
§ 371 (c)(1),
(2), (4) Date: Feb. 26, 2010

(87) PCT Pub. No.: WO2009/028500
PCT Pub. Date: Mar. 5, 2009

(65) Prior Publication Data

US 2010/0163664 A1 Jul. 1, 2010

(30) Foreign Application Priority Data

Aug. 31, 2007 (JP) ..... 2007-225577

(51) Int. Cl.
*B65H 18/28* (2006.01)

(52) U.S. Cl.
USPC ..... 242/160.4

(58) Field of Classification Search
USPC ..... 242/159, 160.1, 160.4, 522, 530, 530.1, 242/530.2
See application file for complete search history.

(56) References Cited

U.S. PATENT DOCUMENTS

| | | | | |
|---|---|---|---|---|
| 5,494,731 | A * | 2/1996 | Fereshtehkhou et al. | 428/211.1 |
| 6,916,403 | B2 * | 7/2005 | Basler et al. | 428/154 |
| 2006/0071119 | A1 * | 4/2006 | Zeitlin | 242/598.3 |
| 2009/0117331 | A1 * | 5/2009 | Fung et al. | 428/154 |
| 2009/0155512 | A1 * | 6/2009 | Neto et al. | 428/43 |
| 2009/0297781 | A1 * | 12/2009 | Huss et al. | 428/166 |

FOREIGN PATENT DOCUMENTS

| | | |
|---|---|---|
| JP | H6-38895 | 2/1994 |
| JP | 2003-61861 | 3/2003 |
| JP | 2003-276936 | 10/2003 |
| JP | 2004-209082 | 7/2004 |
| JP | 2007-21168 | 2/2007 |

* cited by examiner

*Primary Examiner* — William A Rivera
(74) *Attorney, Agent, or Firm* — DLA Piper LLP (US)

(57) ABSTRACT

[Problem] To reduce roll paper curl of a sanitary thin paper roll

[Means for Solving Problem] A sanitary thin paper roll in the present invention comprising two or more ply sheets for constituting a roll wherein a basis weight of a sanitary thin paper sheet on an outermost face of the roll is smaller than a basis weight of a sanitary thin paper sheet on an innermost face of the roll, and a density of the sanitary thin paper sheet on the outermost face of the roll is larger than a density of the sanitary thin paper sheet on the innermost face of the roll.

8 Claims, 3 Drawing Sheets

SANITARY THIN PAPER ROLL

TECHNICAL FIELD

The present invention relates to a sanitary thin paper roll in which two or more stacked sanitary thin paper sheets are wound around a tubular core that is of practically the same width as the sheets.

BACKGROUND ART

The sanitary thin paper rolls are known as kitchen paper rolls and paper rolls for domestic and business uses, rolled wipes and wastes for wiping mechanical appliances and instruments, and others, and have a structure in which long sheets are wound around a tubular core made of a paper tube or the like that is of practically the same width as the sheets.

Taking a kitchen paper roll as an example, the width of the sheets (tubular core) is about 220 to 280 mm, and the outer diameter of the tubular core is 30 to 50 mm. The winding length of the sheets is 10 to 13 m, and the outer diameter of the sheets wound around the tubular core is 90 to 130 mm.

A user generally holds the sanitary thin paper roll typified by such a kitchen paper roll with one hand, and continuously unrolls and cuts the sheets by a required length with the other hand. Accordingly, to facilitate cutting for use, the sanitary thin paper roll has generally lines of perforation formed in a direction of a sheet width at predetermined longitudinal intervals.

However, if the user has his/her hands wet or soiled in the middle of cooking or the like, the user may place the sanitary thin paper roll in portrait orientation (the sheet width is vertically positioned) on a kitchen counter or the like, and may hold the roll at the upper (end) side with one elbow and continuously unroll and cut the roll by a required length with the other hand. Patent Document 1: JP H6-38895 A

DISCLOSURE OF THE INVENTION

Technical Problem to be Solved

However, when a conventional sanitary thin paper roll is continuously unrolled and cut by a required length in such usage as stated above, a cut piece of paper tends to be hard to flatten because of the remained roll paper curl. Such a curled piece of paper is hard to use.

Therefore, a main object of the present invention is to provide a sanitary thin paper roll in which a continuously unrolled and cut piece of paper of a length required for use tends to easy to flatten and use because of the reduced roll paper curl.

Means to Solve the Problem

The present invention to solve the problem is as follows:

[The Invention According to Claim 1]

A sanitary thin paper roll in which two or more stacked sanitary thin paper sheets are wound around a tubular core that is of practically the same width as the sheets, wherein in the sheets, a basis weight of a sanitary thin paper sheet on an outermost face of the roll is smaller than a basis weight of a sanitary thin paper sheet on an innermost face of the roll, and a density of the sanitary thin paper sheet on the outermost face of the roll is larger than a density of the sanitary thin paper sheet on the innermost face of the roll, both the basis weight of the sanitary thin paper sheet on the outermost face of the roll and the basis weight of the sanitary thin paper sheet on the innermost face of the roll fall within a range of 10 to 50 g/m$^2$, both the density of the sanitary thin paper sheet on the outermost face of the roll and the density of the sanitary thin paper sheet on the innermost face of the roll fall within a range of 100 to 250 kg/m$^3$, and a value D of (the density of the sanitary thin paper sheet on the innermost face of the roll)/(the density of the sanitary thin paper sheet on the outermost face of the roll) falls within a range $0.6 \leq D \leq 1.0$.

(Principal Operational Advantage)

The cut piece of paper tends to be easy to flatten and use because of the reduced roll paper curl by setting the basis weight of the sanitary thin paper sheet on the outermost face of the roll so as to be smaller than the basis weight of the sanitary thin paper sheet on the innermost face of the roll and by setting the density of the sanitary thin paper sheet on the outermost face of the roll so as to be larger than the density of the sanitary thin paper sheet on the innermost face of the roll.

Here, the sanitary thin paper sheet on the outermost face of the roll refers to, out of the sanitary thin paper sheets, a sanitary thin paper sheet located on the outermost face of the roll wound around the tubular core. In contrast, the sanitary thin paper sheet on the innermost face of the roll refers to, out of the sanitary thin paper sheets, a sanitary thin paper sheet located on the face nearest to the tubular core around which the sheets are wound. Therefore, with regard to a double-sheet (or two-ply) roll, the sanitary thin paper sheet on the outermost face of the roll is synonymous with a sanitary thin paper sheet on an outer face of the roll, and the sanitary thin paper sheet on the innermost face of the roll is synonymous with a sanitary thin paper sheet on an inner face of the roll.

Meanwhile, the density in the present invention refers to a value obtained by dividing the basis weight by a thickness of one sanitary thin paper sheet.

In addition, with the density within the foregoing value range, the cut piece of paper tends to be excessively easy to flatten and use because of the further reduced roll paper curl.

[The Invention According to Claim 2]

The sanitary thin paper roll according to Claim 1, wherein, with regard to the basis weight of the sanitary thin paper sheet on the outermost face of the roll and the basis weight of the sanitary thin paper sheet on the innermost face of the roll, a value B of (the basis weight of the sanitary thin paper sheet on the innermost face of the roll)/(the basis weight of the sanitary thin paper sheet on the outermost face of the roll) meets a relationship of $1.3 \leq B$.

(Principal Operational Advantage)

With the value B satisfying the foregoing numerical relation, a cut piece of paper tends to be readily flattened because of the further reduced roll paper curl, and therefore is excessively easy to use.

[The Invention According to Claim 3]

The sanitary thin paper roll according to any one of Claims 1 and 2, wherein the sheets have lines of perforation formed in a direction of a sheet width at predetermined longitudinal intervals.

(Principal Effect and Operation)

The foregoing roll is easy to cut for use. In addition, the roll can be cut by an appropriate length so as not to be curled easily.

[The Invention According to Claim 4]

The sanitary thin paper roll according to any one of Claims 1 to 3, wherein the sheets are manufactured by applying or spraying water to the sanitary thin paper sheet that is to be located on the outermost face of the roll and then stacking the sanitary thin paper sheet on the outermost face of the roll on a single or a plurality of sanitary thin paper sheets that are to be located on the inner face of the roll.

(Principal Operational Advantage)

After or when the sanitary thin paper sheet that is to be located on the outermost face of the roll is stacked on other sanitary thin paper sheet(s), the sheets become shrunk due to water evaporation, whereby the roll paper curl can be further prevented.

In addition, the sheets become less prone to let oil pass through and therefore are effective in wiping oil contents.

Advantage of the Invention

According to the present invention, it is possible to provide a sanitary thin paper roll that is readily flattened and therefore is easy to use because of the reduced roll paper, even when the sanitary thin paper roll is continuously unrolled and cut by a length required for use.

BEST MODE FOR CARRYING OUT THE INVENTION

Next, an embodiment of a sanitary thin paper roll in the present invention will be described below, mainly taking a kitchen paper roll as an example.

The sanitary thin paper roll herein is not limited to a kitchen paper roll and refers to any roll of long sanitary thin paper wound around a tubular core. The sanitary thin paper herein refers to disposable thin paper, such as paper napkins, facial paper, toilet paper, CHIRI-GAMI, tissue paper, kitchen paper, paper towel, kitchen towel, paper wipes, paper wastes, and others, for example.

FIGS. 1 to 3 show a kitchen paper roll with lines of perforation 10 in this embodiment. The kitchen paper roll 10 is formed by winding a belt-like sheet 1*a* around a tubular core 2 that is made of a paper tube or the like and is practically the same width as the sheet.

The tubular core 2 may be any of known cores. For example, the tubular core generally has an outer diameter L of about 30 to 50 mm and a width H of about 100 to 183 mm.

Meanwhile, a winding length of the sheet 1*a* in this embodiment may be 10 to 13 m that is a general length. In using the tubular core 2, an outer diameter of the kitchen paper roll 10 is 90 to 130 mm. This is a general size of a commercially available kitchen paper roll.

The sheet 1*a* of this embodiment characteristically has a so-called two-ply structure in which two kitchen paper sheets are stacked; a basis weight of a sanitary thin paper sheet A located on an outer face of the roll is smaller than a basis weight of a sanitary thin paper sheet B located on an inner face of the roll; and a density of the sanitary thin paper sheet A on the outer face of the roll is larger than a density of the sanitary thin paper sheet B on the inner face of the roll.

In the present invention, the sheet 1*a* is not limited to this embodiment and may have a structure of two or more plies. Therefore the sheet 1*a* may have a structure of three or more plies. The present invention is more effective with a two-ply or three-ply structure, and in particular, is remarkably effective with a two-ply structure.

In the case with a structure of three or more plies, it is preferred to set a basis weight and a density of an intermediate sanitary paper, between the sanitary thin paper sheet A on the outermost face of the roll and the sanitary thin paper sheet B on the innermost face of the roll, so as to fall within a numerical range intermediate between the basis weights and densities of the sanitary thin paper sheets on the outermost and innermost faces of the roll.

Here, in the kitchen paper roll 10 of this embodiment, both the basis weights of the sanitary thin paper sheet A on the outermost face of the roll and the sanitary thin paper sheet B on the innermost face of the roll fall within a range of 10 to 50 $g/m^2$. If the basis weights are less than 10 $g/m^2$, the kitchen paper is decreased in strength and may be broken in actual use. If the basis weights are more than 50 $g/m^2$, the kitchen paper becomes too hard and may be difficult to fold in actual use.

In addition, both the densities of the sanitary thin paper sheet A on the outermost face and the sanitary thin paper sheet B on the innermost face preferably fall within a range of 100 to 250 $kg/m^3$. If the densities are less than 100 $kg/m^3$, the kitchen paper is lowered in strength and may be broken in actual use. If the densities are more than 250 $kg/m^3$, the kitchen paper becomes too hard and may be difficult to fold in actual use.

Further, in the kitchen paper roll 10 of this embodiment, the value D of (the density of the sanitary thin paper sheet on the innermost face of the roll)/(the density of the sanitary thin paper sheet on the outermost face of the roll) preferably falls within a range of $0.6 \leq D \leq 1.0$. If the value D is less than 0.6, a difference in tension caused by sheet winding becomes large between the sanitary thin paper sheet on the innermost face and the sanitary thin paper sheet on the outermost face, thereby making it difficult to wind the paper uniformly in a processing operation. In contrast, if the value D exceeds 1.0, the paper is largely curled.

Moreover, in the kitchen paper roll 10, the value B of (the basis weight of the sanitary thin paper sheet on the innermost face of the roll)/(the basis weight of the sanitary thin paper sheet on the outermost face of the roll) meets a numerical relation of $1.3 \leq B$. With the value B of less than 1.3, the present invention is less effective in reducing of the sheet curling. The present invention is expected to be most effective in reducing of the sheet curling if both the values D and B fall within the foregoing ranges.

Meanwhile, the sheet 1*a* of the kitchen paper roll 10 in this embodiment is preferably manufactured by applying or spraying water to the sanitary thin paper sheet A that is to be located on the outermost face of the roll and then stacking the sanitary thin paper sheet that is to be located on the outermost face on a single or a plurality of sanitary thin paper sheets that are to be located on an inner face of the roll.

Especially preferably, the sanitary thin paper sheet A that is to be located on the outermost face is stacked on other sanitary thin paper sheet(s) before the sanitary thin paper sheet A is dried completely. A preferred amount of water applied to the sanitary thin paper sheet A that is to be located on the outermost face accounts for about 3 to 6% of a weight of one sanitary thin paper sheet A. The amount of applied water needs to be set at least to such a degree not leading to a situation in which, when the sheets are stacked together, the water is supplied to adjacent sanitary thin paper sheet(s) and a water content difference is erased between the outermost sheet and the other sheet(s).

In the sheet 1*a* manufactured as stated above, the roll paper curl can be further prevented because, when or after the sanitary thin paper sheet A that is to be located on the outermost face of the roll is stacked over other sanitary thin paper sheet(s), the sheets are shrunk due to water evaporation. On top of that, if the sheet 1*a* is used for a kitchen paper roll, the sheet 1*a* is less prone to let oil pass through and therefore has excellent properties required in particular for a kitchen paper roll, in absorption of excess oil from fried foods and wiping of soils at a kitchen, for example.

Meanwhile, as particularly shown in FIGS. 1 and 3, the sheet 1*a* of this embodiment has lines of perforation 1*b* formed in the sheet width direction at predetermined longitudinal intervals M. The lines of perforation 1*b*, 1*b* . . . facilitate cutting of the sheet 1*a*. Each of the predetermined intervals M is preferably about 48 to 250 mm. If the interval M is less than 48 mm, a cut piece of paper is too small in size for actual use. If the interval M is more than 250 mm, a cut piece of paper is larger in size as compared with kitchenware and others, and therefore is hard to use.

The lines of perforation 1*b* can be formed by any known perforation roll (machine blade roll) facility. Specifically, the lines of perforation 1*b* can be formed in the width direction of the sheet 1*a* at the predetermined longitudinal intervals M, by rotating a perforation roll wider than the width H of the sheet 1*a* and bringing the roll into contact with the running sheet 1*a*, the perforation roll having a plurality of blade lines along a circumference of the roll at pitches identical to the predetermined longitudinal intervals M and each of the blade lines having a large number of blades arranged in a width direction.

Meanwhile, the kitchen paper roll 10 of this embodiment has preferably the lines of perforation 1*b* provided in double- or more multiple-lined form, as shown in the illustrated example. If the lines of perforation 1*b* are arranged in double- or more multiple-lined form, the sheet is likely to be lift from the line of perforation 1*b* to a sheet leading edge 1*c*. In addition, the lines of perforation 1*b* provided in double- or more multiple-lined form would decrease a possibility that the sheet may be broken in the sheet longitudinal direction.

The lines of perforation 1*b* may be provided in triple-, quadruple-, or more multiple-lined form, for example. The lines of perforation can be arranged in multiple-lined form by the use of a perforation roll facility including a perforation roll with a plurality of appropriate blade lines.

In addition, the lines of perforation 1*b* in this case may not be provided entirely in double-lined form in the sheet width direction, and may be provided in double-lined form only at a side of the sheet 1*a*, for example.

Further, if the lines of perforation 1*b* are provided in double-lined form, it is possible to facilitate sheet cutting by making cut portions in zigzag alignment in the lines of perforation, or by making each line of perforation at a right or acute angle with respect to a straight line linking an end of a cut portion in one line of perforation and an end of a cut portion of the other line of perforation nearest to the end of the former cut portion, with reference to JP 2003-276936 A or the like, for example.

Meanwhile, the kitchen paper roll 10 of this embodiment has preferably a sheet longitudinal tensile strength of 10 to 200 cN (more preferably 40 to 60 cN) at the lines of perforation 1*b*. If the sheet longitudinal tensile strength at the lines of perforation 1*b* is 10 cN or more, it is possible to reliably prevent that the sheet is cut involuntarily at any line of perforation 1*b* while the sheet is unrolled, even if the lines of perforation 1*b* are increased in number by shortening the intervals between the lines of perforation 1*b*. In contrast, if the sheet longitudinal tensile strength at the lines of perforation 1*b* is 200 cN or less, the sheet 1*a* can be cut reliably and easily at a desired line of perforation 1*b*.

Here the term "tensile strength" refers to a tensile strength of the sheet in a dry state that is measured in accordance with the determination of tensile properties defined in JIS P 8113. Specifically, this term refers to not a tensile strength of the sheet 1*a* itself, that is, the sheet 1*a* with no lines of perforation 1*b*, but a tensile strength of the sheet 1*a* with the lines of perforation 1*b*, which is measured across the lines of perforation 1*b*.

The longitudinal tensile strength of the sheet at the lines of perforation 1*b* can be regulated by adjusting a length of a tie as a connecting part at each line of perforation 1*b* and a length of a cut as a cutting part at the same, or by adjusting a tie-cut ratio as a ratio of the tie length and the cut length. More specifically, the tensile strength can be regulated by using a perforation roll with blade lines of desired tie and cut lengths and a desired tie-cut ratio. In addition, the tensile strength may also be regulated by adjusting a linear pressure of the perforation roll on the sheet 1*a* (a pressing force (kgf/cm) applied to the sheet 1*a* per sheet unit width) or adjusting a winder speed (speed of winding the sheet 1*a*).

Meanwhile, in the kitchen paper roll 10 of this embodiment, a ratio of the longitudinal tensile strength of the sheet 1*a* at each line of perforation 1*b* to the longitudinal tensile strength of the sheet 1*a* itself is preferably 1.0 to 50% (more preferably 2.0 to 10%). If the tensile strength ratio is 50% or less, the tensile strength of the sheet 1*a* at parts with no lines of perforation 1*b* becomes relatively high. Accordingly, it is possible to prevent the sheet 1*a* from being broken at any part with no line of perforation 1*b* and thus to cut the sheet 1*a* reliably at a desired line of perforation 1*b*. In contrast, if the tensile strength ratio is 1.0% or more, the tensile strength of the sheet 1*a* at the lines of perforation 1*b* becomes relatively high. This makes it possible to reliably prevent the sheet 1*a* from being involuntarily cut at any line of perforation 1*b* while the sheet 1*a* is unrolled, even if the lines of perforation 1*b* are increased in number by shortening the intervals between the lines of perforation 1*b*.

Here, the longitudinal tensile strength of the sheet 1*a* itself is also measured in accordance with the determination of tensile properties defined in JIS P 8113. Of course, this tensile strength is obtained by measuring the sheet 1*a* at a part with no line of perforation 1*b* in a dry state. The tensile strength ratio can be readily regulated by adjusting the above-mentioned tie-cut ratio or the like.

In order to set the longitudinal tensile strength of the sheet at lines of perforation 1*b* at 10 to 200 cN and set the tensile strength ratio at 1.0 to 50%, it is necessary to set the tie length of the lines of perforation 1*b* at 0.9 to 2.5 mm; the cut length of the same at 0.9 to 37.5 mm; and the tie-cut ratio (tie:cut) at 1:15 to 1:1.

Meanwhile, in the kitchen paper roll 10 of this embodiment, a ratio of the widthwise tensile strength of the sheet 1*a* itself to the longitudinal tensile strength of the sheet 1*a* itself is preferably 10 to 80% (more preferably 10 to 40%). If the tensile strength ratio falls within a range of 10 to 80%, fiber orientation of the sheet 1*a* is appropriately balanced between longitudinal and widthwise directions.

Therefore, the sheet 1*a* can freely extend in the longitudinal and widthwise directions against a shearing force that is caused during unrolling of the sheet 1*a*. Accordingly, the sheet 1*a* becomes less prone to be torn in the longitudinal and widthwise directions. Accordingly, the sheet 1*a* can be properly cut at a desired line of perforation 1*b*, thereby making the sheet 1*a* easy to use.

In adjusting the tensile strength ratio as stated above, the longitudinal tensile strength of the sheet 1*a* itself is preferably 200 to 2,200 cN (more preferably 1,000 to 2,000 cN), and the widthwise tensile strength of the same is preferably 100 to 800 cN (more preferably 300 to 600 cN).

If the longitudinal tensile strength of the sheet 1*a* itself is less than 200 cN, the sheet 1*a* may be torn when the sheet 1*a* is unrolled or becomes wet with water due to decreased paper strength. In contrast, if the longitudinal tensile strength of the sheet 1*a* itself exceeds 2,200 cN, the sheet 1*a* losses flexibility and becomes hard to use due to too strong paper strength. Meanwhile, if the widthwise tensile strength of the sheet 1*a* itself is less than 100 cN, the sheet 1*a* may be torn when the sheet 1*a* is unrolled or becomes wet with water due to decreased paper strength. In contrast, if the widthwise tensile strength of the sheet 1*a* itself exceeds 800 cN, the sheet 1*a* loses flexibility and becomes hard to use due to too strong paper strength. The term "tensile strength" here refers to a tensile strength of the sheet 1*a* in a dry state at parts with no lines of perforation 1*b*, which is also measured in accordance with the determination of tensile properties defined in JIS P 8113.

The tensile strength ratio can be regulated by adjusting a ratio of jet speed/wire speed (J/W ratio) to appropriately increase a volume of fibers oriented in a flow direction as compared with a volume of fibers oriented in a width direction, or the like.

Here, there is no particular limitation to the kind of pulp fibers as a material for the sheet 1*a*. Such pulp fibers may be originated from wood pulp, non-wood pulp, synthetic pulp, recycled pulp, or the like, for example. More specifically, one or several kinds of pulps can be selected from among mechanical pulps (MP) such as groundwood pulp (GP), stone groundwood pulp (SGP), refiner groundwood pulp (RGP), pressure groundwood (PGW), thermomechanical pulp (TMP), chemi-thermomechanical pulp (CTMP), and bleached chemi-thermomechanical pulp (BCTMP); kraft pulps (KP) such as a chemi-groundwood pulp (CGP), a semi-chemical pulp (SCP), a Nadelholz (needle) bleached kraft pulp (NBKP), and a Laubholz (leaf) bleached kraft pulp (LBKP); chemical pulps (CP) such as an alkali pulp (AP), a sulfite pulp (SP), and a dissolving pulp (DP); synthetic pulps made from nylon, rayon, polyester, polyvinyl alcohol (PVA), or the like; recycled pulps such as a deinked pulp (DIP) and a waste pulp (WP); tailing pulps (TP); rag pulps made from cotton, flax, hemp, jute, Manila hemp, ramie, or the like; culm pulps such as a straw pulp, an esparto pulp, a bagasse pulp, a bamboo pulp, a kenaf pulp, and the like; and auxiliary pulps such as a bast pulp.

However, it is preferred to use a raw material pulp in which a mass ratio of NBKP to LBKP falls within a range of 100:0 to 40:60. This provides the sheet 1*a* with a combination of strength increase by the use of NBKP and flexibility improvement by the use of LBKP. Accordingly, it can be prevented that the sheet 1*a* is cut involuntarily at an undesired line of perforation 1*b* during sheet unrolling, without deterioration in flexibility or the like.

EXAMPLES

Followings are descriptions on testing and evaluating the roll paper curl of the sanitary thin paper roll according to the present invention, and test and evaluation results.

<Test Method>

The procedure for the test will be described below with reference to FIG. 4. Spray glue ("TY-LAS22N" produced by KOKUYO S&T Co., Ltd.) is uniformly sprayed for three seconds onto one entire side of one sanitary thin paper sheet from a distance of about 20 cm. Then, another sanitary thin paper sheet is stuck on the foregoing sanitary thin paper sheet in such a manner that the two sheets are mutually aligned in the flow direction and the width direction, thereby to form a two-ply sheet 11 (hereinafter referred to simply as sheet).

In addition, the sheet is cut out into a size of 1 cm (width direction)×20 cm (flow direction), and the cut sheet piece is wound around a stainless pipe 13 with a diameter of 1.2 cm and a length of 30 cm, as shown in FIGS. 4(A) and 4(B). At the time, a mending tape T-118 (18 mm×35 m) 14, produced by KOKUYO Co., Ltd. is cut out into a size of 18 mm×6 mm, and the cut tape piece is fixed to the pipe at a winding start portion of the sheet. In addition, the cut mending tape 14 is used to fix the sheet at a winding end portion (tail portion) for prevention of unwinding.

The pipe is left in such a winding state for 24 hours at a constant temperature and humidity room (temperature: 20° C., humidity: 50%). After that, the sheet is unfixed at the winding end portion, and the pipe is horizontally placed such that the winding start portion is located on the upper side and the winding end portion on the lower side, in a vertical direction.

Next, as shown in FIG. 4(C), the mending tape 14 at the tail portion is removed to unwind the sheet and the pipe is held such that an axial direction thereof is horizontally positioned. Then, the sheet 11 is temporarily drawn out until the tail end thereof unattached to the pipe 13 reaches the lowest position, and immediately afterward the drawn end is released.

After the release, a distance R from the pipe-side end of the sheet 11 to the lowest position of the same is measured. With the larger value of R, the sheet 11 has the smaller roll paper curl, and with the smaller value of R, the sheet 11 has the larger roll paper curl.

The foregoing test was carried out using various sanitary thin paper sheets with varied basis weights and densities on outer and inner faces of the roll. Table 1 shows basis weights and densities of the sanitary thin paper sheets, and the values D and B with ratings.

The ratings are four: "very good (R≥10 cm, ◎)"; "good (7≤R<10 cm, ○)"; "baddish (4.5≤R<7 cm, Δ)"; and "bad (R<4.5 cm, x)."

TABLE 1

| | | Basis weight and density of sanitary thin paper sheet on the outermost face of the roll | | | | | |
|---|---|---|---|---|---|---|---|
| | | 22 g/m2, 220 kg/m3 | 26 m2, 173 kg/m3 | 24 g/m2, 170 kg/m3 | 33 g/m2, 165 kg/m3 | 22 g/m2, 165 kg/m3 | 32 g/m2, 133 kg/m3 |
| Basis weight and density of sanitary thin paper sheet on the innermost face of the roll | 22 g/m2, 220 kg/m3 | | D = 1.7<br>B = 0.7<br>D/B = 2.4<br>x (R = 3 cm) | D = 1.3<br>B = 0.8<br>D/B = 1.6<br>x (R = 2.5 cm) | D = 1.3<br>B = 0.8<br>D/B = 1.6<br>Δ (R = 6.5 cm) | D = 1.3<br>B = 1.0<br>D/B = 1.3<br>x (R = 1.5 cm) | D = 1.3<br>B = 1.0<br>D/B = 1.3<br>Δ (R = 5.5 cm) |
| | 26 g/m2, 173 kg/m3 | D = 0.8<br>B = 1.2<br>D/B = 0.7<br>○ (R = 7.0 cm) | | D = 1.7<br>B = 0.7<br>D/B = 2.4<br>Δ (R = 5.5 cm) | D = 1.3<br>B = 0.8<br>D/B = 1.6<br>Δ (R = 6.5 cm) | D = 1.3<br>B = 0.8<br>D/B = 1.6<br>x (R = 1.5 cm) | D = 1.3<br>B = 1.0<br>D/B = 1.3<br>x (R = 3.0 cm) |
| | 24 g/m2, 170 kg kg/m3 | D = 0.8<br>B = 1.1<br>D/B = 0.7 | D = 1.0<br>B = 0.9<br>D/B = 1.1 | | D = 1.7<br>B = 0.7<br>D/B = 2.4 | D = 1.3<br>B = 0.8<br>D/B = 1.6 | D = 1.3<br>B = 1.0<br>D/B = 1.3 |

TABLE 1-continued

| | Basis weight and density of sanitary thin paper sheet on the outermost face of the roll | | | | | |
|---|---|---|---|---|---|---|
| | 22 g/m2, 220 kg/m3 | 26 m2, 173 kg/m3 | 24 g/m2, 170 kg/m3 | 33 g/m2, 165 kg/m3 | 22 g/m2, 165 kg/m3 | 32 g/m2, 133 kg/m3 |
| 33 g/m2, 165 kg/m3 | ○ (R = 7.5 cm)<br>D = 0.8<br>B = 1.5<br>D/B = 0.5 | ○ (R = 8.0 cm)<br>D = 1.0<br>B = 1.3<br>D/B = 0.8 | D = 1.0<br>B = 1.4<br>D/B = 0.7 | Δ (R = 6.0 cm) | × (R = 3.5 cm)<br>D = 1.3<br>B = 0.8<br>D/B = 1.6 | Δ (R = 4.5 cm)<br>D = 1.3<br>B = 1.0<br>D/B = 1.6 |
| 22 g/m2, 165 kg/m3 | ◎ (R = 10.0 cm)<br>D = 0.8<br>B = 1.0<br>D/B = 0.8 | ◎ (R = 10.0 cm)<br>D = 1.0<br>B = 0.9<br>D/B = 1.1 | ◎ (R = 12.5 cm)<br>D = 1.0<br>B = 0.9<br>D/B = 1.1 | D = 1.0<br>B = 0.7<br>D/B = 1.4 | Δ (R = 5.5 cm) | x (R = 3.0 cm)<br>D = 1.3<br>B = 1.0<br>D/B = 1.3 |
| 32 g/m2, 133 kg/m3 | ○ (R = 9.5 cm)<br>D = 0.6<br>B = 1.5<br>D/B = 0.4 | ○ (R = 9.0 cm)<br>D = 0.8<br>B = 1.2<br>D/B = 0.7 | ○ (R = 9.0 cm)<br>D = 0.8<br>B = 1.3<br>D/B = 0.6 | ○ (R = 7.5 cm)<br>D = 0.8<br>B = 1.0<br>D/B = 0.8 | D = 0.8<br>B = 1.5<br>D/B = 0.5 | x (R = 2.0 cm) |
| | ◎ (R = 18.0 cm) | ○ (R = 8.5 cm) | ◎ (R = 10.0 cm) | ○ (R = 8.0 cm) | ◎ (R = 11.0 cm) | |

The test has revealed that preferable results tend to be obtained if the sanitary thin paper sheet on the outer face of the roll has a smaller basis weight and a larger density than those of the sanitary thin paper sheet on the inner face of the roll. In particular, remarkably good ratings tend to be earned if the basis weight of the sanitary thin paper sheet on the outer face of the roll and the basis weight of the sanitary thin paper sheet on the inner face of the roll fall within a range of 10 to 50 g/m$^2$; the density of the sanitary thin paper sheet on the outer face of the roll and the density of the sanitary thin paper on the inner face of the roll fall within a range of 100 to 250 kg/m$^3$; the value D of (the density of the sanitary thin paper sheet on the inner face of the roll)/(the density of the sanitary thin paper sheet on the outer face of the roll) is $0.6 \leq D \leq 1.0$; and with regard to the basis weight of the sanitary thin paper sheet on the outermost face of the roll and the basis weight of the sanitary thin paper sheet on the innermost face of the roll, a value B of (the basis weight of the sanitary thin paper sheet on the inner face of the roll)/(the basis weight of the sanitary thin paper sheet on the outer face of the roll) meets a relationship of $1.3 \leq B$.

According to the sanitary thin paper roll of the present invention as stated above, it is possible to reduce the roll paper curl of the sanitary thin paper.

INDUSTRIAL APPLICABILITY

The present invention is applicable to a sanitary thin paper roll in which two or more stacked sheets are wound around a tubular core that is of practically the same width as the sheets and the sheets have lines of perforation formed in the sheet width direction at predetermined longitudinal intervals.

DESCRIPTION OF THE REFERENCE NUMERALS

Figure 1:
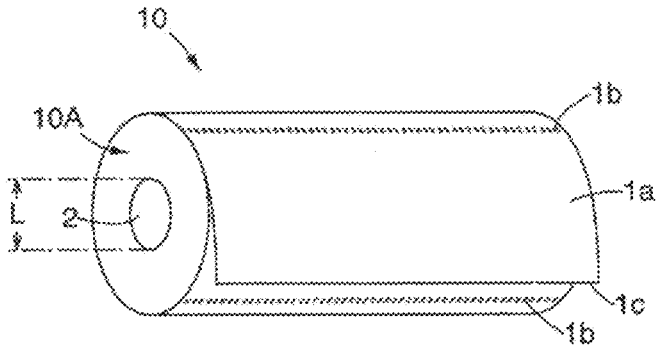
FIG. 1 is a perspective view of a kitchen paper roll of this embodiment.
Figure 2:
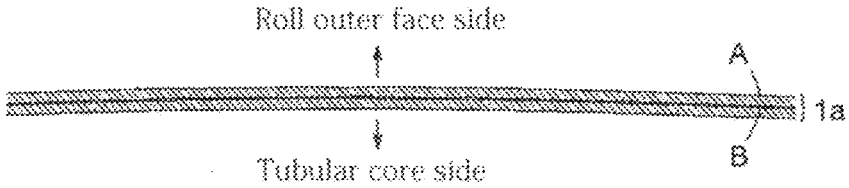
FIG. 2 is a cross-section view of a sheet of the kitchen paper roll in this embodiment.
Figure 3:
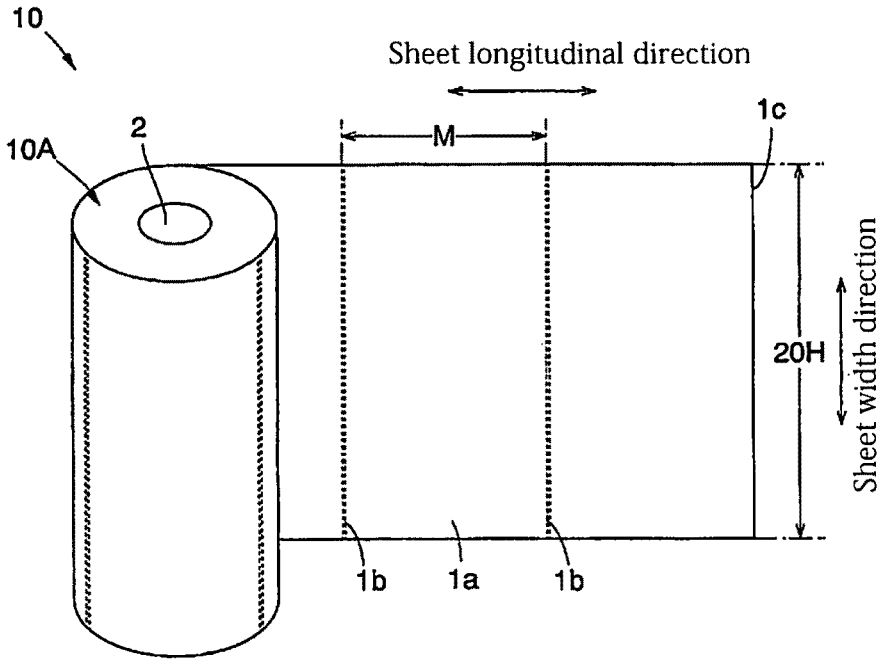
FIG. 3 is a plane view of the unrolled sheet in this embodiment.
Figure 4:
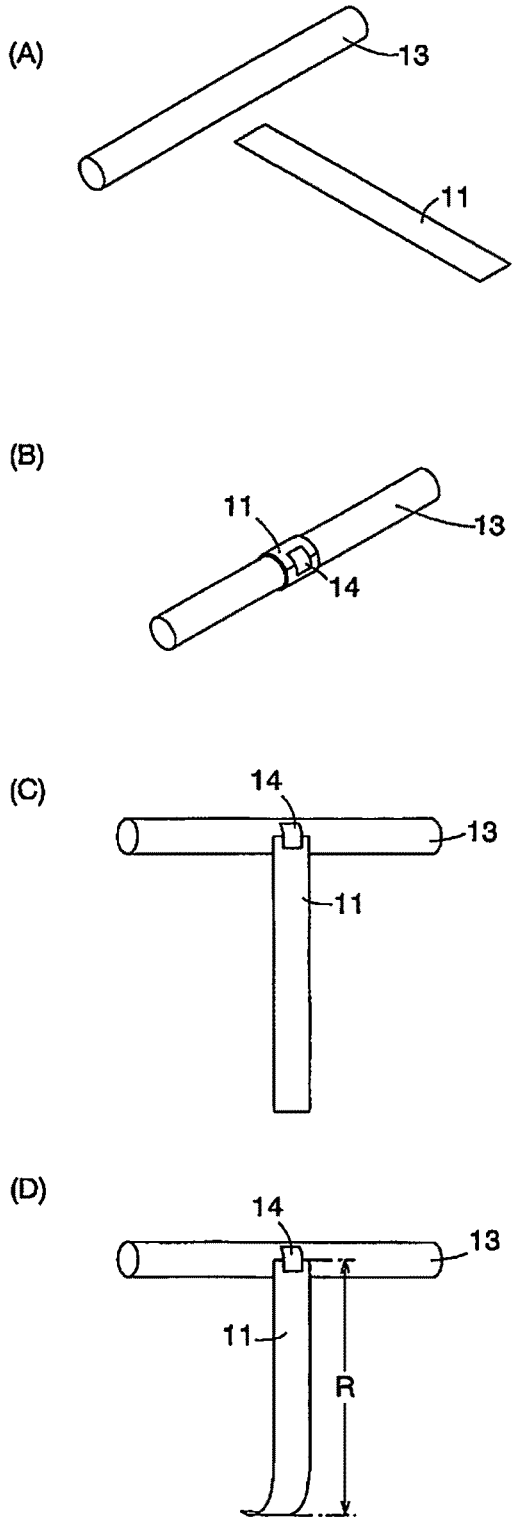
FIG. 4 is a diagram for describing a method of testing and evaluating the sheet for the roll paper curl.

1*a* . . . . Sheet, 1*b* . . . . Line of perforation, 1*c* . . . . Sheet leading edge, 2 . . . Tubular core, 10 . . . Kitchen paper roll, 10A . . . . Upper side, 11 . . . Specimen, 13 . . . Pipe, 14 . . . Mending tape, 20H . . . . Sheet width, A . . . . Sanitary thin paper on an outermost face of the roll, B . . . . Sanitary thin paper on an innermost face of the roll, L . . . . Outer diameter of a tubular core, M . . . . Predetermined interval, R . . . . Drooping length of a specimen after pipe winding

The invention claimed is:

1. A sanitary thin paper roll comprising:

two stacked sanitary thin paper sheets wound around a tubular core of practically the same width as the sheets, wherein in the sheets, a basis weight of a sanitary thin paper sheet on an outermost face of the roll is smaller than a basis weight of a sanitary thin paper sheet on an innermost face of the roll, and a density of the sanitary thin paper sheet on the outermost face of the roll is larger than a density of the sanitary thin paper sheet on the innermost face of the roll, both the basis weight of the sanitary thin paper sheet on the outermost face of the roll and the basis weight of the sanitary thin paper sheet on the innermost face of the roll fall within a range of 10 to 50 g/m$^2$, both the density of the sanitary thin paper sheet on the outermost face of the roll and the density of the sanitary thin paper sheet on the innermost face of the roll fall within a range of 100 to 250 kg/m$^3$, and a value of a ratio D, which is a ratio of the density of the sanitary thin paper sheet on the innermost face of the roll to the density of the sanitary thin paper sheet on the outermost face of the roll falls within a range $-0.6 \leq D < 1.0$.

2. The sanitary thin paper roll according to claim 1, wherein, with regard to the basis weight of the sanitary thin paper sheet on the outermost face of the roll and the basis weight of the sanitary thin paper sheet on the innermost face of the roll, a value of a ratio B, which is a ratio of the basis weight of the sanitary thin paper sheet on the innermost face of the roll to the basis weight of the sanitary thin paper sheet on the outermost face of the roll meets a relationship of $1.3 \leq B$.

3. The sanitary thin paper roll according to claim 2, wherein the sheets have lines of perforation formed in a direction of a sheet width at predetermined longitudinal intervals.

4. The sanitary thin paper roll according to claim 3, wherein the sheets are manufactured by applying or spraying water to the sanitary thin paper sheet that is to be located on the outermost face of the roll and then stacking the sanitary thin paper sheet on the outermost face of the roll on a single or a plurality of sanitary thin paper sheets that are to be located on the inner face of the roll.

5. The sanitary thin paper roll according to claim 2, wherein the sheets are manufactured by applying or spraying water to the sanitary thin paper sheet that is to be located on the outermost face of the roll and then stacking the sanitary thin paper sheet on the outermost face of the roll on a single or a plurality of sanitary thin paper sheets that are to be located on the inner face of the roll.

6. The sanitary thin paper roll according to claim 1, wherein the sheets have lines of perforation formed in a direction of a sheet width at predetermined longitudinal intervals.

7. The sanitary thin paper roll according to claim 6, wherein the sheets are manufactured by applying or spraying water to the sanitary thin paper sheet that is to be located on the outermost face of the roll and then stacking the sanitary thin paper sheet on the outermost face of the roll on a single or a plurality of sanitary thin paper sheets that are to be located on the inner face of the roll.

8. The sanitary thin paper roll according to claim 1, wherein the sheets are manufactured by applying or spraying water to the sanitary thin paper sheet that is to be located on the outermost face of the roll and then stacking the sanitary thin paper sheet on the outermost face of the roll on a single or a plurality of sanitary thin paper sheets that are to be located on the inner face of the roll.

* * * * *